United States Patent [19]

Beall et al.

[11] 4,290,484

[45] Sep. 22, 1981

[54] SEAL RECEPTACLE ASSEMBLY

[75] Inventors: Clifford H. Beall, Broken Arrow, Okla.; Amareswar Amancharla, League City; Michael A. Luke, Houston, both of Tex.

[73] Assignee: Baker International Corporation, Orange, Calif.

[21] Appl. No.: 170,209

[22] Filed: Jul. 18, 1980

[51] Int. Cl.[3] ..... E21B 23/00; E21B 33/10

[52] U.S. Cl. ..... 166/242; 166/315; 277/9; 285/302

[58] Field of Search ..... 166/242, 367, 359, 315, 166/84, 86, 88; 285/302; 277/9, 9.5

[56] References Cited

U.S. PATENT DOCUMENTS

| | | | |
|---|---|---|---|
| 1,367,348 | 2/1921 | Barnes | 285/302 X |
| 1,712,029 | 5/1929 | Crowell et al. | 166/242 X |
| 3,354,950 | 11/1967 | Hyde | 285/302 X |
| 3,416,819 | 12/1968 | Day | 285/302 |
| 3,504,936 | 4/1970 | Brown et al. | 285/302 X |

*Primary Examiner*—Stephen J. Novosad
*Attorney, Agent, or Firm*—William C. Norvell, Jr.

[57] ABSTRACT

A seal receptacle assembly is provided for affixation on a well conduit. The seal receptacle assembly can be provided to permit telescopic contraction and expansion of the well conduit in response to heating, cooling, or pressurization of the well conduit. The seal receptacle assembly includes an inner body sleeve having a lower end connected to the well tool or a conduit member, and an annular sealing element positioned over an outer cylindrical static sealing surface formed on the inner body sleeve. An outer housing having one end connected to the well conduit telescopes over the upper portion of the inner body sleeve. The housing has an inner cylindrical dynamic sealing surface for sealingly and slidably engaging the sealing element. Means, such as a radially compressible retaining ring, are mounted in an outer groove formed on the inner body sleeve above the sealing element, or, alternatively, a collet is provided, for maintaining the sealing element on the static sealing surface during normal expansion and contraction of the seal receptacle assembly. Upward movement of the outer housing causes the retaining ring, or collet, to expand outwardly into an inner groove in the housing and permit the housing to lift the sealing element off the static sealing surface. The sealing element and the dynamic sealing surface can then be removed from the well in a single retrieval operation.

18 Claims, 14 Drawing Figures

SEAL RECEPTACLE ASSEMBLY

BACKGROUND OF THE INVENTION

1. FIELD OF THE INVENTION

The present invention relates generally to subsurface equipment for subterranean wells and, in particular, to a seal receptacle for connection in a well conduit for permitting expansion and contraction of the conduit.

2. DESCRIPTION OF THE PRIOR ART

Typically, a tubing string in a subterranean well is secured to a well casing by utilizing one or more packers or other well tools spaced at predetermined intervals along the tubing.

Well tubing is subjected to a wide range of temperature and pressure variations which may result in contraction and expansion of the tubing. Consequently, a seal receptacle assembly is connected in the well tubing to permit the tubing to expand and contract without inducing any load on the packer assembly or other well tool. Such seal receptacle assemblies typically have a lower end connected to the upper portion of the packer assembly or other well tool and an upper end connected to the lower end of the well tubing or conduit.

Prior art seal receptacle assemblies typically include an inner seal mandrel having a lower end connected to the well tool, and an outer seal housing having an upper end connected to the lower end of the well tubing or other conduit. The outer housing has an inner cylindrical polished surface in which is mounted an annular sealing element. The outer housing and the sealing element telescope over the upper portion of the seal mandrel. The seal mandrel has an outer cylindrical polished surface for sealingly and slidably engaging the sealing element. Since the polished surface on the outer housing remains static relative to the sealing element, this surface is typically referred to as the static sealing surface. The polished surface on the seal mandrel slides within the sealing element and, therefore, is typically referred to as the dynamic sealing surface.

There are several problems associated with the prior art seal receptacle assemblies. First, since the dynamic sealing surface is on the outside surface of the mandrel, it must be protected against any marring which subsequently would damage the seals. This problem leads to increased costs in both the manufacturing and handling operations of the mandrel.

Another problem occurs after the seal receptacle assembly has been down hole for some time and it is desired to replace the sealing element and redress the dynamic sealing surface. In prior art seal receptacle assemblies, this process requires two separate retrieval operations. First, the well tubing is pulled up the well conduit with the outer housing and the seal element. Next, a second retrieval operation is performed to retrieve the dynamic sealing surface on the seal mandrel. During this retrieval process, the unprotected outer dynamic sealing surface is easily damaged.

SUMMARY OF THE INVENTION

The present invention provides a seal receptacle assembly which permits the seal and the dynamic sealing surface to be retrieved from the well in a single retrieval operation. The seal receptacle assembly includes a lower body sleeve having a lower end connected to the upper end of a well tool, such as a packer assembly or a well conduit member. An annular seal means is positioned on an outer cylindrical static sealing surface formed on the inner body sleeve. An outer housing having an upper end connected to the lower end of a well tubing telescopes over the upper portion of the inner body sleeve. The housing has an inner cylindrical dynamic sealing surface for sealingly and slidably engaging the seal means. As the well tubing is subjected to the heating, cooling, and pressurization by the well fluid, the expansion and contraction of the well tubing causes the outer housing to move longitudinally relative to inner body sleeve.

In accordance with the present invention, means are provided which engage the inner body sleeve for maintaining the seal means on the static sealing surface of the inner body sleeve during normal expansion and contraction of the seal receptacle assembly. However, when it is desired to replace the seal means and redress the dynamic sealing surface, upward retrieval movement of the housing disengages such seal maintaining means from the inner body sleeve to permit the housing to lift the seal means off the static sealing surface. The seal means and the outer housing are then lifted up the well with the well tubing.

After the seal means has been replaced and the dynamic sealing surface redressed, the outer housing having the new seals mounted therein is re-run down the well, where the new seals are transferred onto the static sealing surface and the seal maintaining means re-engages the inner body sleeve.

DESCRIPTION OF THE PREFERRED EMBODIMENTS

Figure 1:
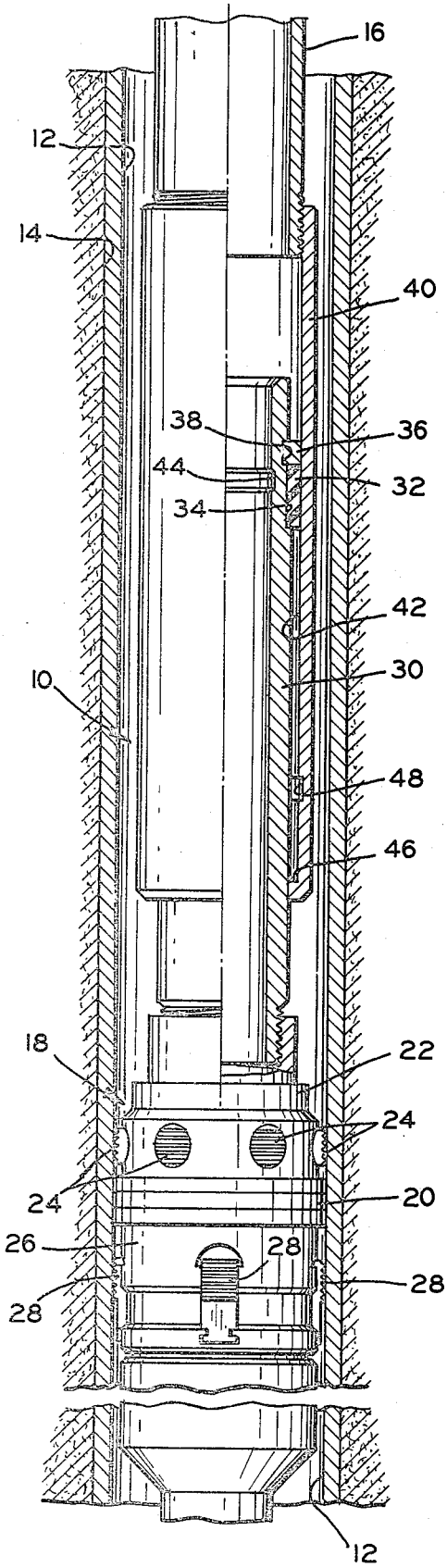
FIG. 1 is a schematic diagram, in partial cross-section, of a seal receptacle assembly according to the present invention connected in a tubing string in a subterranean well.

Referring to FIG. 1, there is shown in schematic diagram form a seal receptacle assembly 10 which is suspended within a well casing 12 positioned in a subterraean bore 14. The seal receptacle assembly 10 is connected between a well tubing 16 and a packer assembly 18.

The packer assembly 18 shown in the Figures includes a resilient packing element 20 which has been expanded to sealingly engage the inner wall of the well casing 12. The packer assembly 18 has an upper portion 22 and a plurality of circumferentially spaced, radially extendable hold down buttons 24 which have been expanded to grip the side wall of the well casing 12. The packer assembly 18 also includes a lower portion 26 having a plurality of circumferentially spaced slips 28 which have been expanded to grip the inner wall of the casing 12. The buttons 24 and the slips 28 militate against any longitudinal movement of the packer assembly 18 relative to the casing 12, while the packing element 20 seals between the upper and lower external areas of the packer assembly. Of course, it is understood that the present seal receptacle assembly is by no means limited to use with this type of packer, the seal receptacle assembly being designed for use with a number of down hole packers, bridge plugs, hangers, and the like.

Although not shown in FIG. 1, the packer assembly 18 extends downwardly and is in fluid communication with a production zone of a subterranean well, while the well tubing 16 extends upwardly to the top of the well. Generally, the well tubing 16 will be subjected to a wide range of temperature and pressure variations. The seal receptacle assembly 10 permits telescopic expansion and contraction of the well tubing without inducing any substantial load on the packer assembly 18.

The seal receptacle assembly 10, which is shown schematically in FIG. 1, includes an inner body sleeve 30 having a lower end connected to the upper portion 22 of the packer assembly 18. An annular seal means 32 is positioned on an outer cylindrical polished static sealing surface 34 of the sleeve 30. The seal means 32 is releasably mounted on the inner body sleeve by a radially compressible seal maintaining means, such as latching means, or, as illustrated, a retainer ring 36 positioned in an annular groove 38.

The seal receptacle assembly 10 also includes an outer housing 40 which telescopes over the upper portion of the inner body sleeve 30 and has an upper end connected to the well tubing 16. The outer housing 40 has an inner cylindrical polished dynamic sealing surface 42 which slidably engages the seal means 32 as the well tubing expands and contracts longitudinally. The cylindrical surface 42 also maintains the retainer ring 36 within the groove 38 to militate against any longitudinal movement of the seal means 32 relative to the sleeve 30. Thus, the outer cylindrical surface 34 on the sleeve 30 functions as the static sealing surface, while the inner cylindrical surface 42 of the housing 40 functions as the dynamic sealing surface.

When it is desired to replace the annular seal means 32 and/or redress the dynamic sealing surface 42, a conventional wire line plug (not shown) is lowered down the well tubing 16 and set in an annular recess 44 formed in the sleeve 30. Next, upward retrieval movement of the well tubing 16 pulls the housing 40 upwardly until a lower shoulder 46 formed at the extreme lower end of the housing 40 engages the lower end of the seal means 32. At this time, the retainer ring 36 is radially aligned with an inner annular groove 48 formed in the housing 40 and expands outwardly into the groove 48 to permit the seal means to be lifted from the inner body sleeve 30 and carried, or transferred, to the tubing 16 and on the shoulder 46. The housing 40 and the seal means 32 can then be lifted up the well with the well tubing 16, wherein the seal means can be replaced and the dynamic seal surface 42 can be redressed.

ONE EMBODIMENT OF THE SEAL RECEPTACLE ASSEMBLY

Figure 2A:
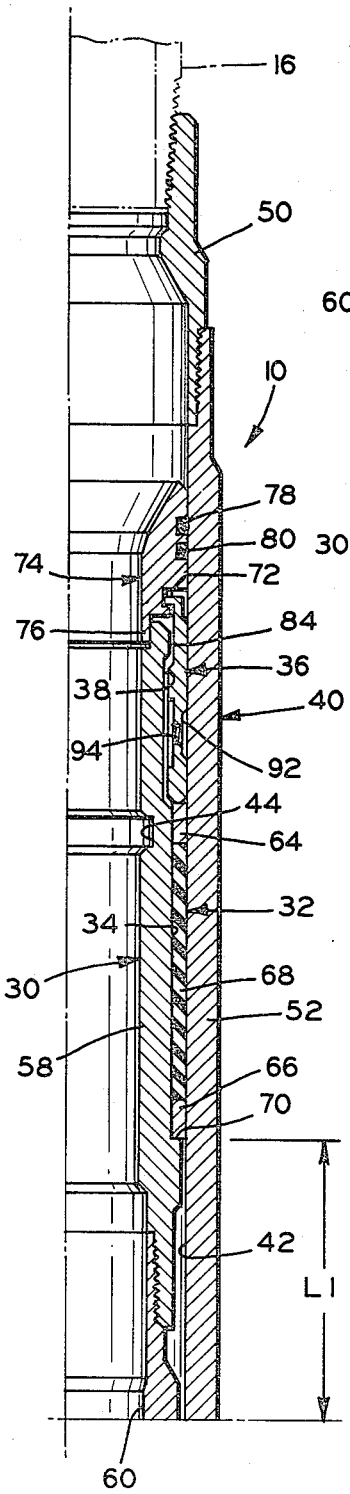
FIGS. 2*a* and 2*b* together constitute a quarter sectional view, illustrating the seal receptacle assembly of FIG. 1 in a setting position after it has been connected to a packer assembly, FIG. 2*b* being a lower vertical continuation of FIG. 2*a*.
Figure 2B:
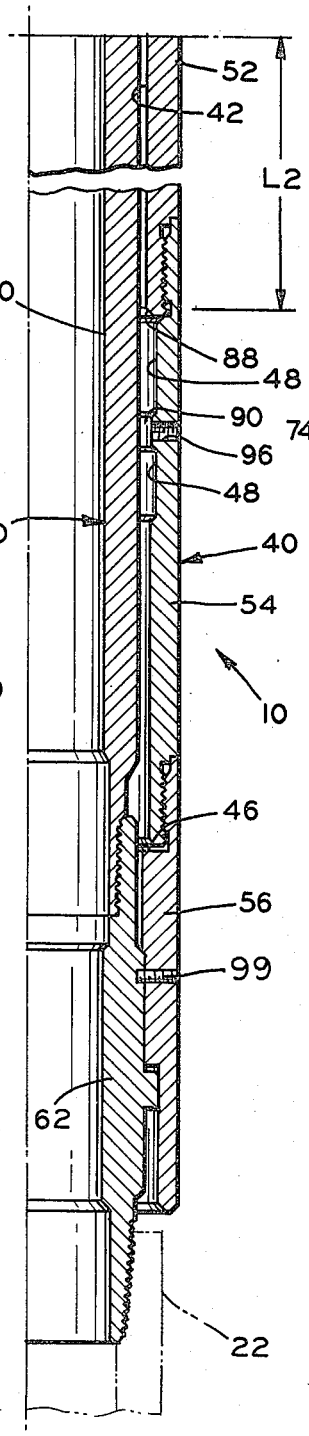

There is shown in FIGS. 2*a* and 2*b* a quarter sectional view of the seal receptacle assembly 10 schematically shown in FIG. 1. The outer housing 40 includes four components: an upper top sub 50, a seal housing 52, a snap ring housing 54, and a lower latch housing 56. The top sub 50 has an upper end threaded onto the well tubing 16 and a lower end threaded into the upper end of the seal housing 52. The seal housing 52 extends downwardly and is threaded into the upper end of the snap ring housing 54. The lower end of the snap ring housing 54 is threaded into the upper end of the latch housing 56.

The inner body sleeve 30 includes an upper seal sleeve 58, an intermediate extension sleeve 60 therebelow, and a lower locking sleeve 62. The upper seal sleeve 58 has a lower end threaded onto the upper end of the extension sleeve 60. The extension sleeve 60 extends downwardly and is threaded into the upper end of the locking sleeve 62. The locking sleeve 62 has a lower end threaded into the upper end 22 of the packer assembly or tubing.

The annular seal means 32 is positioned around the static sealing surface 43 formed on the seal sleeve 58. The seal means 32 includes an upper retainer 64 and a lower retainer 66. An annular resilient sealing element 68 is positioned intermediate the retainers 64 and 66. The static sealing surface 34 extends longitudinally the length of the seal means 32 and terminates at its lower end in an outwardly projecting shoulder 70 which provides a lower seat for the retainer 66.

The seal means 32 is prevented from moving longitudinally relative to the inner body sleeve 30 by the latching means or retaining ring 36 which is positioned within the annular groove 38 formed around the upper end of the seal sleeve 58. The retaining ring 36 typically has a generally "C"-shaped cross-section and is radially compressed into the groove 38 by contact with the the dynamic sealing surface 42 of the seal housing 40. The upper end of the retainer ring 36 has a radially inwardly extending lip 72 formed thereon for interconnecting the ring 36 with an annular upper end portion 74.

The end portion 74 has an extreme lower end 76 which is slidably inserted around the interior of the upper end of the seal sleeve 58. A pair of O-rings 78 and 80 are positioned in a pair of outer annular grooves formed in the end portion 74 to prevent fluid communication between the end portion 74 and the seal housing 40. The end portion 74 functions as a debris barrier to prevent any foreign material, such as mud, sand or silt from entering the area surrounding the retaining ring 36.

When the ring 36 is compressed into the groove 38 by the inner surface 42, the retaining ring 36 is prevented from upward movement by a annular shoulder 84 formed at the upper end of the sleeve 58 and in turn prevents upward movement by the seal means 32.

The shoulder 70 prevents any downward movement of the seal means 32 relative to the inner body sleeve 30.

Figure 3:
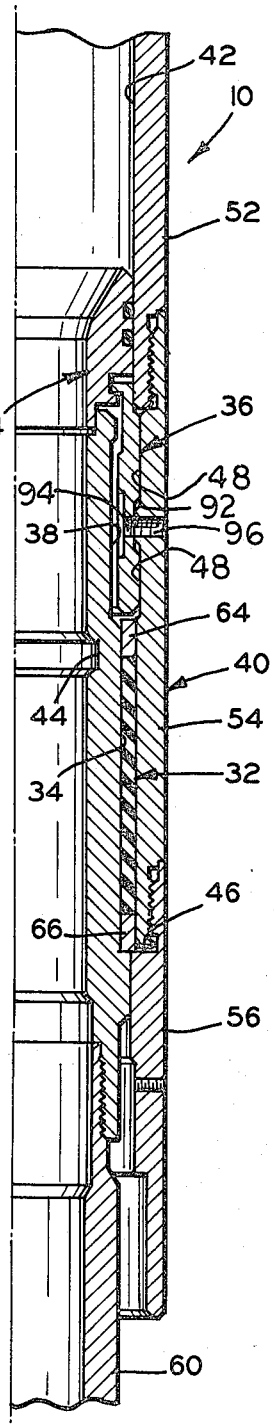
FIG. 3 is a quarter sectional view, similar to FIGS. 2*a* and 2*b*, but illustrating the seal receptacle assembly in retrieval position wherein the seal means and the dynamic sealing surface are removed from the well in a single retrieval operation.
Figure 4:
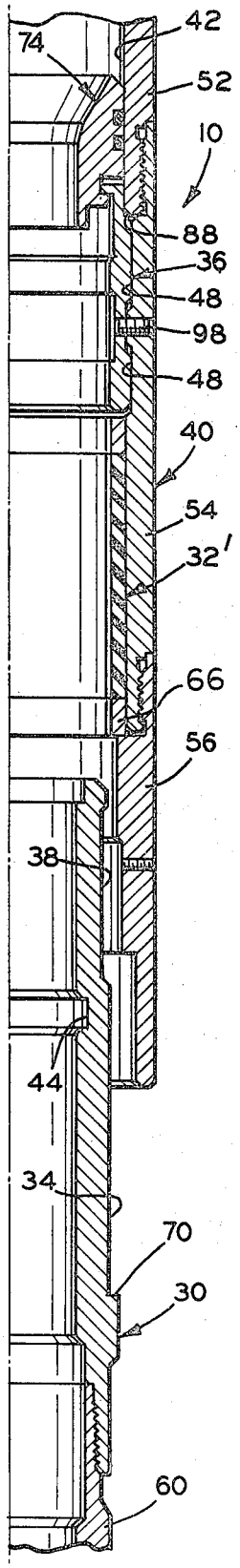
FIG. 4 is a quarter sectional view, similar to FIGS. 2*a* and 2*b*, but illustrating the seal receptacle assembly in a re-running position wherein new seals are lowered down the well bore with the dynamic sealing surface.

The inner annular groove 48, which provides a means for releasing the retaining ring 36 from the inner body sleeve 30, is formed in the upper end of the snap ring housing 54. The upper end of the groove 48 terminates in an inner tapered surface 88 formed at the extreme lower end of the seal housing 52. A smaller diameter portion 90 is formed in the intermediate portion of the groove 48. When the housing 40 is pulled upwardly such that the groove 48 is longitudinally aligned with the retaining ring 36, as shown in FIG. 3, the ring 36 expands radially outwardly into the groove 48. The portion 90 cooperates with an annular recess 92 formed in the ring 36 to vertically align a pair of threaded apertures 94 and 96 formed in the ring 36 and the snap ring housing 54 respectively. When aligned, the apertures 94 and 96 can receive a threaded shear pin 98, as shown in FIG. 4, which is utilized in the rerunning operation of the outer housing 40 and seal means 32.

The initial setting of the entire seal receptacle assembly 10 into the packer assembly or other well tool is accomplished by first connecting the outer housing 40 to the inner sleeve 30 by a threaded shear pin 99, prior to running the assembly 10 in the well. As shown in FIG. *2b*, the pin 99 extends through the side wall of the latch housing 56 and partially into the locking sleeve 62.

OPERATION

FIGS. *2a* and *2b* illustrate the seal receptacle assembly 10 in the setting position. In this position, the shear pin 99 is threaded into the lower latch housing 56 and the locking sleeve 62, to prevent any relative movement between the inner body sleeve 30 and the outer housing 40. The upper end of the outer housing 40 is attached to the well tubing 16 and the lower end of the locking sleeve 62 of the inner body sleeve 30 is attached to the upper end of the packer 18, or other down hole tool, or tubing section. The entire assembly is lowered down the well casing 12. The well tubing 16 may then be manipulated as required to set the packer 18, or other tool. Once the packer 18 is securely locked in place with respect to the internal surface of the casing 12, the threaded pin 99 may be sheared by pulling up on the well tubing 16 and the outer housing 40. Alternatively, assuming that an appropriate down hole tool or tubing section is affixed to the lower end of the seal receptacle assembly 10, the threaded pin may be sheared by pushing down on the well tubing 16 and the outer housing 40. Once the pin 99 is sheared, the seal receptacle 10 is in an operating condition such that the outer housing 40 can move longitudinally relative to the inner body sleeve 30 in response to heating, cooling, or pressurization by the well fluids.

It should be noted that the seal means 32 is static with respect to the sealing surface 34 formed around the inner body sleeve 30. In operation, fluid pressure from inside the well tubing 16 exerts a downward force on the seal means 32, which is prevented from moving downwardly by the engagement of the lower retainer 66 with the shoulder 70. Fluid pressure outside the well tubing 16 exerts an upward force on the seal means 32. Upward movement of the seal means 32 is prevented by the retaining ring 36, which is compressed into the groove 38 by the inner dynamic sealing surface 42. This prevents the ring 36 from being pulled upward past the shoulder 84.

The stroke length of the slick joint is determined by the lengths of the intermediate extension sleeve 60 and the seal housing 52. In FIGS. *2a* and *2b*, the stroke length is the sum of the lengths L1 and L2.

After the seal receptacle assembly 10 has been in the well for some time, it may become necessary to replace the seal means 32 and redress the dynamic sealing surface 42 on the housing 40. The upward retrieval operation of the seal receptacle assembly 10 is shown in FIG. 3. The seal means is transferred from the inner body sleeve 30 to the outer seal housing 40 during upward retrieval movement of the housing 40. Thus, the dynamic sealing surface and the seal means may be pulled up the well in a single retrieval operation.

First, when it is desired to replace the seal means 32, a conventional wire line set plug (not shown) is lowered down the well tubing 16 and set into the recess 44. Next, the well tubing 16 and the outer seal housing 40 are pulled upwardly, as shown in FIG. 3, until the lower shoulder 46 on the latch housing 56 engages the lower retainer 66 of the seal means 32. When the inner body sleeve 30 and the outer housing 40 are oriented in this position, the groove 48 in the snap ring housing 54 is longitudinally aligned with the retaining ring 36. At this time, the ring 36 expands radially outwardly into the groove 48. Further upward movement of the outer housing 40 lifts the seal means 32 off the inner body sleeve 30. The upper end portion 74, the retaining ring 36, and the seal means 32 are then pulled up the well with the outer seal housing 40.

After the seal means 32 has been replaced and the dynamic sealing surface 42 redressed, the outer housing 40 and the new seals 32 may be re-run within the well conduit. This rerunning operation is illustrated in FIG. 4. Thus, a new seal means 32' is positioned in the lower portion of the snap ring housing 54. The retainer ring 36 is located in the groove 48 and held securely therein by the threaded shear pin 98. As the outer seal housing 40 is moved downwardly over the upper end of the inner body sleeve 30, the seal means 32' slides onto the static sealing surface 34. When the lower retainer 66 abuts the shoulder 70, the seal means 32' is prevented from any further downward movement. Further downward force of sufficient magnitude applied to the housing 40 causes the threaded pin 98 to shear and the housing 40 to move downwardly relative to the inner body sleeve 30. This causes the tapered surface 88 at the lower end of the seal housing 52 to engage the retaining ring 36 and radially compress the ring 36 into groove 38. The dynamic sealing surface 42 is then moved downwardly into engagement with the seal means 32'. The wire line plug (not shown), which has previously been set into the recess 44, is then removed to return the seal receptacle assembly 10 to an operating condition.

FIRST ALTERNATE EMBODIMENT

There is shown in FIGS. *5a*, *5b*, 6, 7, *8a* and *8b*, an alternate embodiment 100 of the seal receptacle assembly 10. Basically, in the alternate embodiment, means are provided for maintaining the sealing element on the static sealing surface which do not require the use of a shear pin when the outer housing is being re-run onto the inner body sleeve. This permits the outer housing and new seal means to be set on the inner body sleeve, lifted off, and reset without having to pull the outer hosuing up the well to replace the shear pin.

Figure 5A:
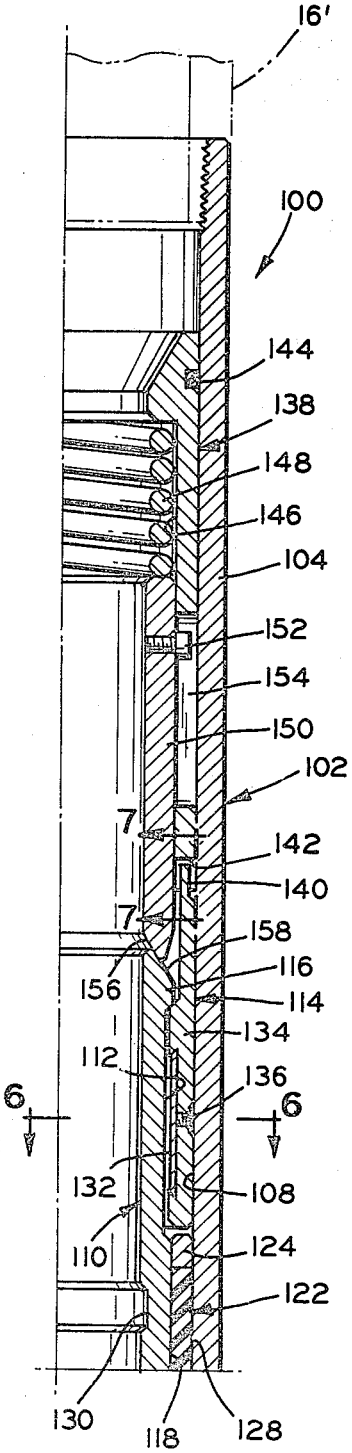
FIGS. 5*a* and 5*b* together constitute a quarter sectional view, illustrating an alternate embodiment of the seal receptacle assembly of FIGS. 2*a* and 2*b* in a setting position, FIG. 5*b* being a lower vertical continuation of FIG. 5*a*.
Figure 5B:
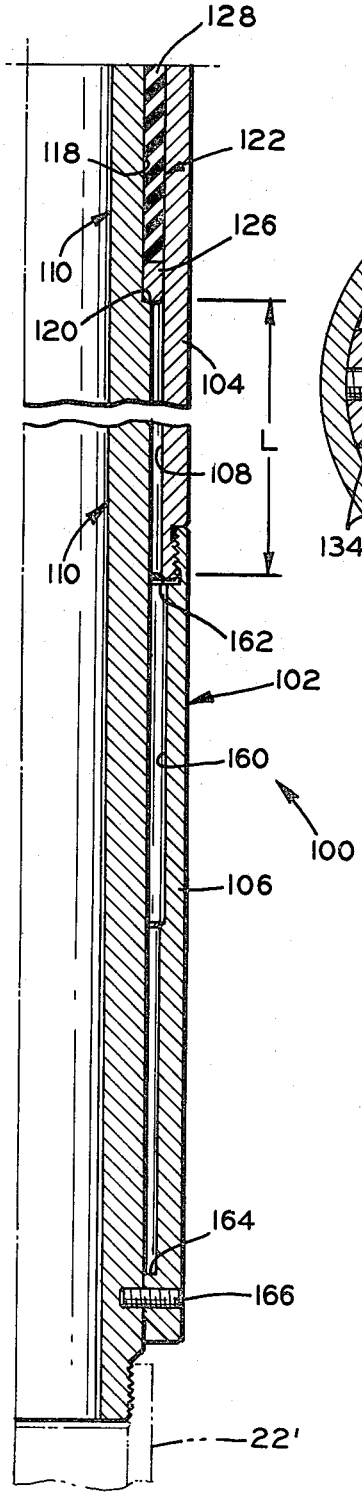

As shown in FIGS. 5*a* and 5*b*, an outer housing 102 includes an upper seal housing 104 having its lower end threaded into the upper end of a snap ring housing 106 and its upper end threaded onto a well tubing 16'. The seal housing 104 has an inner cylindrical polished surface 108 which functions as the dynamic sealing surface of the alternate seal receptacle assembly 100.

The alternate seal receptacle assembly 100 includes an inner body sleeve 110 having its lower end connected to an upper portion 22' of a packer assembly. An outer annular groove 112 is formed on the upper end of the sleeve 110 for receiving a latching assembly 114. The groove 112 terminates at its upper end in an outwardly extending shoulder 116. The inner body sleeve 110 has an outer cylindrical polished surface 118 formed immediately below the groove 112 which functions as the static sealing surface of the first alternate seal receptacle assembly 100. The surface 118 extends downwardly and terminates in a shoulder 120.

An annular seal means 122 is positioned around the static sealing surface 118, and includes an upper retainer 124 and a lower retainer 126 having a resilient sealing element 128 positioned therebetween. An inner annular recess 130 is formed near the upper end of the inner body sleeve 110 for receiving a conventional wire line plug (not shown) when it is desired to stop the well flow and replace the seal means.

Figure 6:
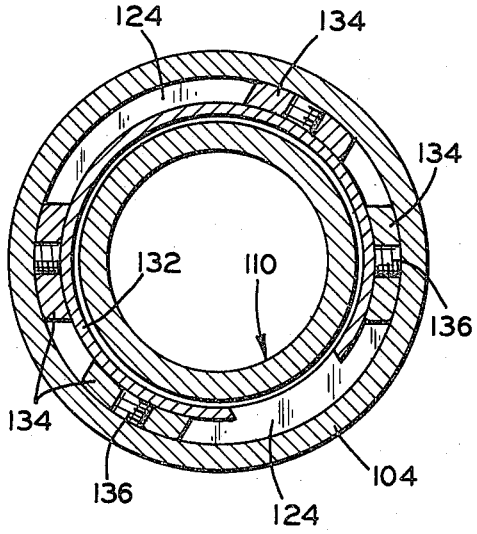
FIG. 6 is a cross-sectional view of the seal receptacle assembly shown in FIGS. 5*a* and 5*b* taken along the line 6—6 of FIG. 5*a*.

The latching assembly 114 functions in a manner similar to the retaining ring 36 of the embodiment shown in FIGS. 2*a* and 2*b* and includes an inner retaining ring 132 having a generally C-shaped cross-section, as shown in FIG. 6. A plurality of elongate lugs 134 are circumferentially spaced around the ring 132. Each of the lugs 134 is secured to the ring 132 by a set screw 136 and the ring 132 exerts an outward radial force to press the lugs 134 against the sealing surface 108.

Figure 7:
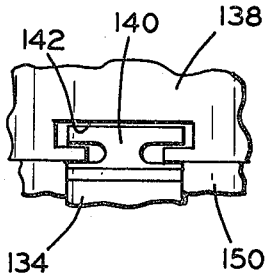
FIG. 7 is an enlarged elevational view taken along line 7—7 of FIG. 5*a*.

Each of the lugs 134 is interconnected with an upper spring housing 138 by a T-shaped upper portion 140, shown in FIG. 7, which cooperates with a respective one of a plurality of slots 142 formed in the extreme lower end of the housing 138. This type of interconnection permits limited radial movement of the lugs 134 relative to the spring housing 138, but militates against any relative longitudinal movement. The spring housing 138 and the latching assembly 14 are slidable together within the seal housing 104. An annular O-ring 144 is retained in an outer annular groove formed in the top of the spring housing 138, to prevent fluid communication between the housing 138 and the seal housing 104. Additionally, the O-ring 144 prevents mud and sand from entering the area around the latching assembly 114.

The upper end of the spring housing 138 has a reduced internal diameter to form a cylindrical cavity 146 for retaining a helical compression spring 148. The lower end of the spring 148 seats on the upper end of an inner mandrel 150. The inner mandrel 150 is positioned within the spring housing for limited longitudinal movement relative to the housing 138. A locating pin 152 is threaded into the side wall of the inner mandrel 150 and extends radially outwardly into a vertical slot 154 formed in the side wall of the spring housing 138. The inner mandrel 150 has a lower tapered surface 156 which engages an upper tapered surface 158 formed at the top end of the inner body sleeve 110.

The snap ring housing 106 has an inner recess 160 formed in the upper portion thereof for receiving the expandable latching assembly when it is desired to lift the seal means 122 from the inner body sleeve. The recess 160 terminates at its upper end adjacent a tapered surface 162 formed at the extreme lower end of the seal housing 104. A lower internal shoulder 164 is formed at the bottom of the snap ring housing for lifting the seal means 122 during the retrieval operation.

OPERATION OF THE FIRST ALTERNATE EMBODIMENT

FIGS. 5*a* and 5*b* illustrate the first alternate seal receptacle assembly 100 in the setting position. In this position, the shear pin 166 is threaded into the lower end of the snap ring housing 106 and into the inner body sleeve 110, as shown in FIG. 5*b*, to prevent any relative longitudinal or rotational movement between the inner body sleeve 110 and the outer housing 102. The outer housing 102 is attached to the well tubing 16' and the lower end of the inner body sleeve 110 is attached to the upper end 22' of the packer. The entire assembly may be then lowered into the well conduit. The well tubing 16' is then manipulated, as required, to set the packer, or other tool. Once the packer is set, the threaded pin 166 can be sheared by pulling on the well tubing 16' and the outer housing 102. Once the pin 166 is sheared, the first alternate seal receptacle assembly 100 is in the operating condition such that the outer housing 102 can telescope relative to the inner body sleeve 110 in response to heating, cooling, or pressurization by the well fluids.

In operation, the seal means 122 remains static with respect to the sealing surface 118 formed on the inner body sleeve 110. The lower shoulder 120 prevents downward movement of the seal means, while the latching assembly 114 is held within the groove 112 by the dynamic sealing surface 108 of the seal housing 104 and the upper shoulder 116 of the inner body sleeve 110 to prevent upward movement of the seal means 122.

The stroke length of the first alternate seal receptacle assembly 100 is determined by the length of the lower portion of the inner body sleeve 110 and the outer seal housing 104. In FIG. 5*b*, the stroke length is represented by dimension L.

When it is desired to replace the seal means 122, a conventional wire line plug (not shown) is lowered down the well tubing 16' and set into the recess 130. Next, the well tubing 16' and the outer seal housing 102 are pulled upwardly until the lower shoulder 164 on the snap ring housing 106 engages the lower retainer 126 of the seal means 122. When the inner body sleeve 110 and the outer housing 102 are oriented in this position, the recess 160 in the snap ring housing 106 is longitudinally aligned with the latching assembly 114 and the lugs 134 expand radially outwardly into the groove 160. Further upward movement of the outer housing 102 lifts the seal means 122 and the latch assembly 114 off the inner body sleeve 110.

As the latching assembly 114 is lifted from the inner body sleeve, the spring 148 exerts a downward force on the inner mandrel 150 such that the lower tapered surface 156 continues to abut the upper tapered surface 158 of the sleeve 110. When the locating pin 152 is positioned at the extreme lower end of the vertical slot 154, the latching assembly 114 has been pulled onto the mandrel 150 and is held in an expanded position in the groove 160 by the outer wall of the mandrel 150. The spring housing 138, the inner mandrel 150, the latching assembly 114 and the seal means 122 are then pulled up the well with the outer seal housing 102.

Figure 8A:
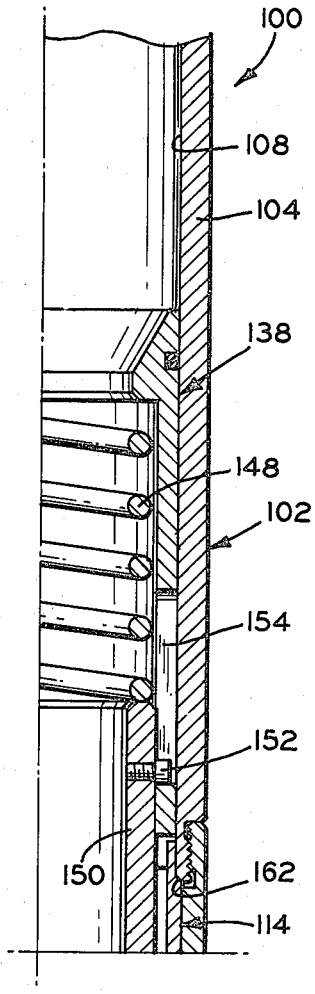
FIGS. 8*a* and 8*b* together constitute a quarter sectional view, similar to FIGS. 5*a* and 5*b*, illustrating the alternate embodiment of the seal receptacle assembly in re-running position, FIG. 8*b* being a lower vertical continuation of FIG. 8*a*.
Figure 8B:
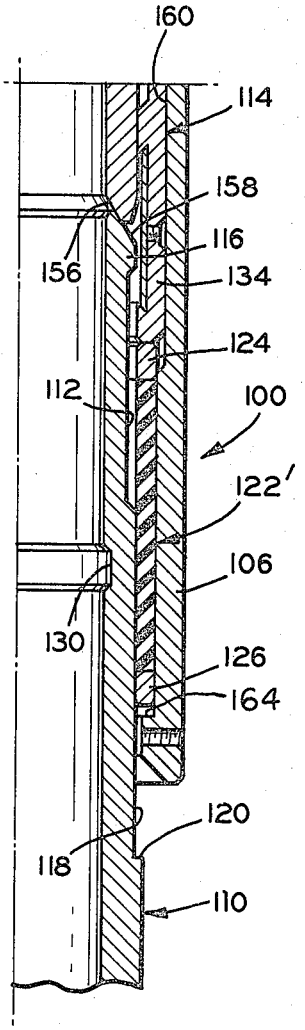

The re-running operation of the first alternate seal receptacle assembly 100 is illustrated in FIGS. 8*a* and 8*b*. In this operation, a new seal means 122' is now positioned in the lower portion of the snap ring housing 106. The latching assembly 114 is located in the groove 160 and is held in an expanded position by the inner mandrel 150. As the outer seal housing 102 is moved downwardly over the upper end of the inner body sleeve 110, the seal means 122' slides onto the static sealing surface 118. Further downward movement of the housing 102 causes the spring housing 138 to compress the spring 148 and slide the latching assembly 114 off the inner mandrel 150 and down into longitudinal alignment with the groove 112.

When the lower retainer ring 126 abuts the shoulder 120, the seal means 122' is prevented from any further downward movement. Further downward force applied to the housing 102 causes the tapered surface 162 to engage the lugs 134 of the latching assembly 114 and radially compress the latching assembly into the groove 112. The dynamic sealing surface 108 is then moved downwardly into engagement with the sealing means 122'. The wire line plug (not shown), which was set into the recess 130, is then removed to return the first alternate seal receptacle assembly 100 to an operating condition.

SECOND ALTERNATE SEAL RECEPTACLE ASSEMBLY

Figure 9A:
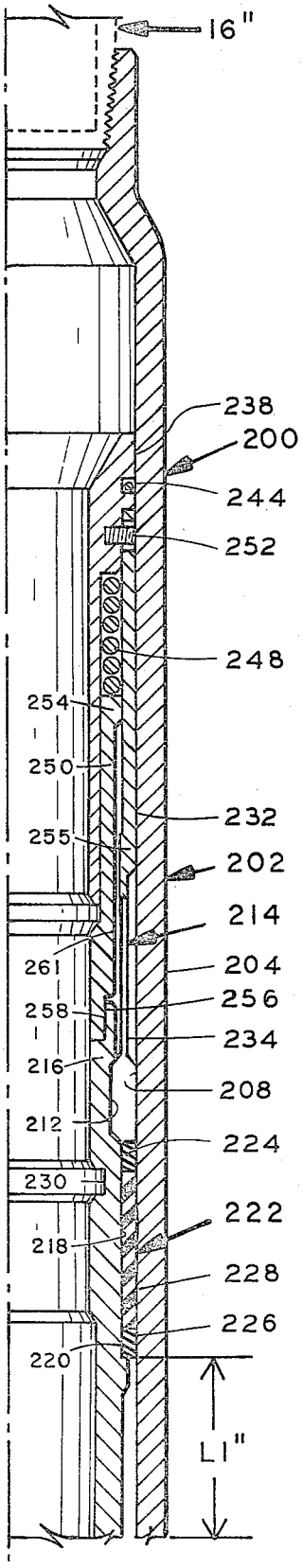
FIGS. 9*a* and 9*b* together constitute a quarter sectional view illustrating a second alternate embodiment of the seal receptacle assembly in a setting position, FIG. 9*b* being a lower vertical continuation of FIG. 9*a*.
Figure 9B:
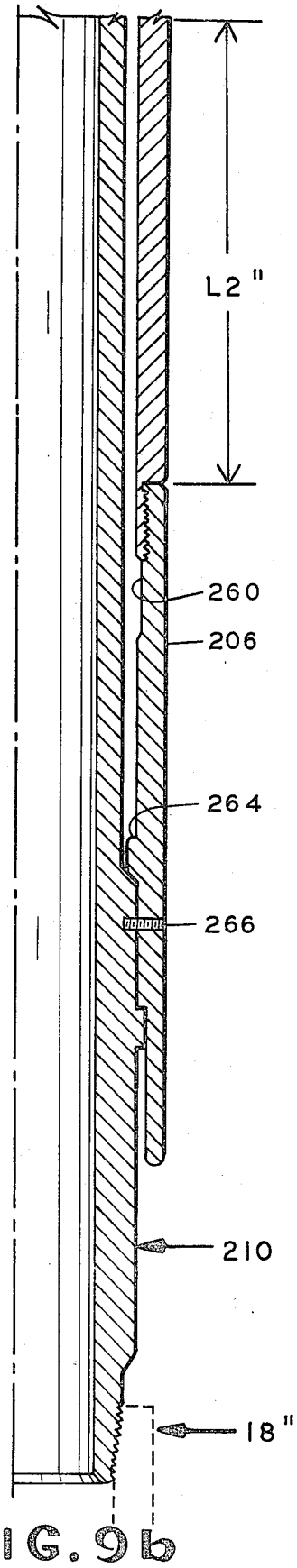
Figure 10:
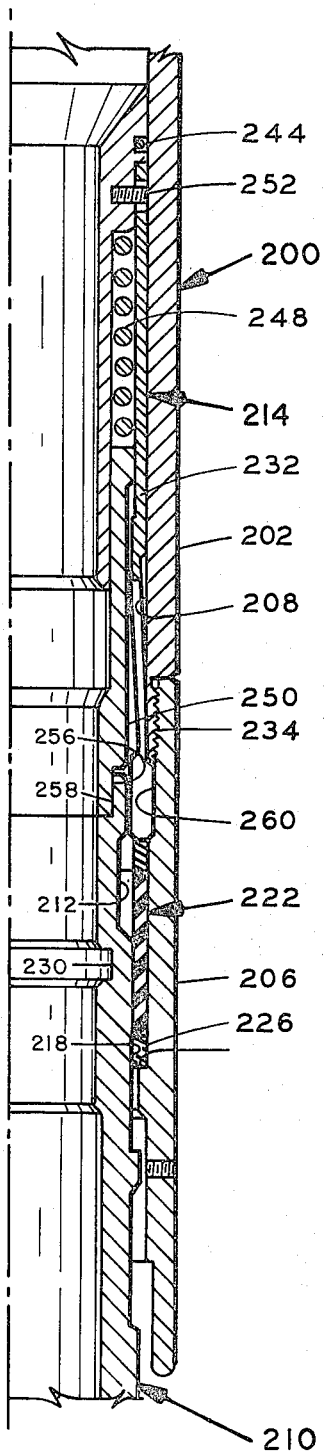
FIG. 10 is a quarter sectional view, similar to FIGS. 9*a* and 9*b*, illustrating the second alternate embodiment of the seal receptacle assembly in re-running position.

There is shown in FIGS. 9*a*, 9*b* and 10 a second alternate embodiment 200 of the seal receptacle assembly 10. Basically, in this second alternate embodiment, a latching means construction is provided which also does not require the use of a shear pin when the outer housing is being re-run onto the inner body sleeve, thus permitting the outer housing and new seal means to be set on the inner body sleeve, lifted off, and reset without having to pull the outer housing up the well to replace the shear pin, as also provided in the first alternate embodiment.

Referring now to FIGS. 9*a* and 9*b*, an outer housing 202 includes an upper seal housing 204 having a lower end threaded into the upper end of a latch housing 206. The seal housing 204 has an upper end threaded onto a well tubing 16''. The seal housing 204 has an inner cylindrical polished surface 208 which functions as the dynamic sealing surface of the second alternate seal receptacle assembly 200.

The second alternate seal receptacle assembly 200 includes an inner body sleeve 210 having a lower end connected to the uppermost end of a packer assembly 18''. An outer annular groove 212 is formed on the upper end of the sleeve 210 for receiving a latching assembly 214. The groove 212 terminates at its upper end in an outwardly extending shoulder 216. The inner body sleeve 210 has an outer cylindrical polished surface 218 formed immediately below the groove 212. The surface 218 functions as the static sealing surface of the second alternate seal receptacle assembly 200 and extends downwardly, terminating in a shoulder 220.

An annular seal means 222 is positioned around the static sealing surface 218 and includes an upper retainer 224, and a lower retainer 226 having a resilient sealing element 228 positioned therebetween. An inner annular recess 230 is formed near the upper end of the inner body sleeve 210 for receiving a conventional wire line plug (not shown) when it is desired to stop the well flow to replace the seal means, as also provided in the initial and first alternate seal receptacle assembly designs.

The latching assembly 214 functions in a manner similar to the retaining ring 36 of the embodiment shown in FIGS. 2*a* and 2*b*, as well as the latching assembly 214 shown in the embodiment illustrated in FIGS. 5*a* and 5*b*. The latching assembly 214 includes a collet sleeve 232 having a plurality of expandable finger elements 234 at the lowermost end thereof. The collet sleeve 232 is securely connected to an upper spring retainer 238 by means of a plurality of locating pins 252 spaced circumferentially around the exterior thereof and secured within the sleeve 232. The upper spring retainer 238 has reduced external diameter in which is positioned a helical compression spring 248 which has its lower seat resting upon the upper end of a collet support sleeve 250. The support sleeve 250 is positioned within the collet sleeve 232 for limited longitudinal movement relative to the collet sleeve 232.

The seal means 232 is prevented from moving upwardly relative to the inner body sleeve 210 by means of the upset portions at the lower end of a plurality of expandable fingers 234 of the collet sleeve 232 which are positioned within the annular groove 212 formed around the upper end of the inner body sleeve 210. The upset portion of the expandable fingers 234 of the collet sleeve 232 are retained in the groove 212 by contact with the internal dynamic sealing surface 208 of the seal housing 204. The collet support sleeve 250 has an extreme lower end 256 which is slidably inserted into the upper end 258 of the inner body sleeve 210. An annular O-ring seal element 244 is retained in an outer annular groove formed in the top of the upper spring retainer 238 to prevent fluid communication between the retainer 238 and the seal housing 204, and to prevent mud and sand from entering the area around the latching assembly 214.

OPERATION OF THE SECOND ALTERNATE SEAL RECEPTACLE ASSEMBLY

FIGS. 9*a* and 9*b* illustrate the second alternate seal receptacle assembly 200 in the setting position. In this position, the shear pin 266 is threaded into the lower end of the latch housing 206 and into the inner body sleeve 210, as shown in FIG. 9*b*, to prevent any relative longitudinal or rotational movement between the inner body sleeve 210 and the outer housing 202. The outer housing 202 is attached to the well tubing 16'' and the lower end of the inner body sleeve 210 is attached to the upper end 18'' of a packer, or other tool. The entire assembly then is lowered down the well conduit. The well tubing 16'' is then manipulated, as required, to set the packer 18''. Once the packer 18'' is securely locked in place with respect to the internal surface of the well conduit, the threaded pin 266 can be sheared by pulling up on the well tubing 16'' and the outer housing 202. Once the pin 266 is sheared, the second alternate seal receptacle assembly 200 is in the operating condition, such that the outer housing 202 can be moved longitudinally relative to the inner body sleeve 210 in response to heating, cooling, or pressurization by well fluids, as the like.

In operation, the seal means 222 remain static with respect to the sealing surface 218 formed on the inner body sleeve 210. The lower shoulder 220 prevents downward movement of the seal means, while the latching assembly 214 is held within the groove 212 by the dynamic sealing surface 208 of the seal housing 204 to prevent upward movement of the seal means.

The stroke length of the second alternate seal receptacle assembly 200 is determined by the length of the lower portion of the inner body sleeve 210 and the outer seal housing 204. In FIG. 9*a* and FIG. 9*b*, the stroke length is represented by dimensions L1" and L2".

When it is desired to replace the seal means 222, a conventional wire line plug (now shown) is lowered down the well tubing 16" and set into the recess 230. Next, the well tubing 16" and the outer seal housing 202 are pulled upwardly until the lower shoulder 264 on the latch housing 206 engages the lower retainer 226 of the seal means 222. When the inner body sleeve 210 and the outer housing 202 are aligned in this position, the recess 260 in the latch housing 206 is longitudinally aligned with the external upset portion of the plurality of fingers 234 of the collet sleeve 232. Futher upward movement of the outer housing 202 lifts the seal means 222 and expands, outwardly, the plurality of fingers 234 of the collet sleeve 232 into the recess 260 of the latch housing 206. The assembly 214 can then be lifted off the inner body sleeve 210. As the latching assembly 214 is lifted from the inner body sleeve 210, the spring 248 exerts a downward force on the collet support sleeve 250 such that the extreme lower end 256 of the collet support sleeve 250 continues to abut the upper end 258 of the internal body sleeve 210 until the upper external shoulder 254 of the collet support sleeve 250 engages the internal shoulder 255 of the collet sleeve 232. In this position, the external upset portions of the plurality of fingers 234 of the collet sleeve 232 are radially held in an expanded position in the recess 260 of the latch housing 206 by the external surface 261 of the collet support sleeve 250. The latching assembly 214 and the seal means 222 are then pulled up the well with the outer housing 202.

The re-running operation of the second alternate seal receptacle assembly 200 is illustrated in FIG. 10. In this operation, a new seal means 222' is positioned in the lower portion of the latch housing 206. The external upset portions of the pluraliy of fingers 234 of the collet sleeve 232 are located in the groove 260 and are held in an expanded position by the collet support sleeve 250. As the outer housing 202 is moved downwardly over the upper end of the inner body sleeve 210, the seal means 222' slides onto the static sealing surface 218 of the inner body sleeve 210, and the extreme lower end 256 of the collet support sleeve 250 engages the upper end 258 of the inner body sleeve 210. Further downward movement of the outer housing 202 causes the collet support sleeve 250 to compress the spring 248 and the upset portion of the plurality of fingers 234 of the collet sleeve 232 is moved downward into longitudinal alignment with the groove 212.

When the lower retainer ring 226 abuts the shoulder 264, the seal means 222' is prevented from any further downward movement. In this position, the upset portion of the plurality of fingers 234 of the collet sleeve 232 collapses into the groove 212. Further downward movement of the outer housing 202 moves the dynamic sealing surface 208 down over the upset portion of the plurality of fingers 234. This locks the latching assembly 214 in place with respect to the inner body sleeve 210. The dynamic sealing surface 208 is then moved downwardly into engagement with the seal means 222'. The wire line plug (not shown), which was set into the recess 230, is then removed to return the second alternate seal receptacle assembly 200 to an operating condition.

It should be noted that the seal receptacle assembly of the present invention also may be provided in a form which is not necessarily required to provide telescopic movement between the inner body sleeve and the outer housing. For example, the present seal receptacle assembly may easily be provided in the form of a latch with seal means. As an example, referring to the embodiment shown in FIGS. 9*a*, 9*b* and 10, the element 210 may actually be part of a packer, or other down hole tool. The shear pin 266 could be provided to retain the elements 210 and 206 together as a unit, thereby preventing telescopic movement therebetween, until such time as it is desired to disengage the tubing conduit 16" from the packer assembly 18". In such event, the tubing conduit 16" is manipulated to overcome the shear strength of the pin 266, and the tubing 16" is picked up to retrieve the seals. Alternatively, the shear pin 266 may be completely removed from the tool prior to insertion in the well, or may be sheared after some other operation in the well. Thus, it can be easily appreciated that the telescopic feature of the seal receptacle assembly of the present invention may be readily adapted to provide a latch for securing a conduit member to another conduit member, or a conduit member to another tool.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A seal receptacle assembly for affixation between first and second members of a tubular conduit in a subterranean well to compensate for longitudinal contraction and expansion of the conduit, said assembly comprising: an inner body sleeve having one end connected to one of the members and defining an outwardly facing static sealing surface; an outer housing circumjacent said inner body sleeve and having one end connected to the other of the members, said outer housing defining an inwardly facing dynamic sealing surface; an annular seal means having an inner surface sealing engaging said static sealing surface and an outer surface sealing engaging said dynamic sealing surface; securing means for releasably securing said seal means to said inner body sleeve whereby said outer housing moves longitudinally relative to said inner body sleeve and said seal means during normal longitudinal contraction and expansion of the tubular conduit; and releasing means operable by extreme upward movement of said outer housing for releasing said securing means and permitting said seal means to be shifted onto and carried by said dynamic sealing surface and to move upwardly with said outer housing, for retrieval from the well.

2. The assembly of claim 1 wherein said inner body sleeve has an outwardly facing annular groove formed therein adjacent one end of said static sealing surface for selective receipt of said securing means.

3. The assembly of claim 1 wherein said inner body sleeve has an outwardly facing annular groove formed therein adjacent one end of said static sealing surface for selective receipt of said securing means, and said securing means includes a radially compressible retaining ring compressed into said annular groove by an inner wall of said outer housing, said retaining ring militating against longitudinal movement of said seal means in one direction with respect to said inner body sleeve.

4. The assembly of claim 3 wherein said releasing means includes an inwardly facing annular groove formed on said outer housing adjacent one end of said dynamic sealing surface whereby, upon longitudinal movement of said outer housing in one direction and alignment of said inwardly facing annular groove with said retaining ring, said retaining ring expands outwardly from said inner body sleeve annular groove into said outer housing annular groove to release said seal means from said inner body sleeve.

5. The assembly of claim 4 wherein said outer housing has an upwardly facing, inwardly extending annular shoulder formed below said annular groove for engaging one end of said seal means whereby said seal means is retrieved with said outer housing from the well.

6. The assembly of claim 1 further comprising means for providing a debris barrier housed within said outer housing and above said seal means to prevent particulate matter within said tubular conduit to enter the area between said inner body sleeve and said outer housing above said seal means.

7. The assembly of claim 1 wherein said inner body sleeve has an otwardly facing annular groove formed therein adjacent one end of said static sealing surface for selective receipt of said securing means, and said securing means includes a radially expandable element received in said annular groove to militate against longitudinal movement of said seal means in one direction with respect to said inner body sleeve.

8. The assembly of claim 1 wherein said inner body sleeve has an outwardly facing annular groove formed therein adjacent one end of said static sealing surface for selective receipt of said securing means when in secured position, and said securing means includes collet means securable to said inner body and into said annular groove by an inner wall of said outer housing to militate against longitudinal movement of said seal means in one direction with respect to said inner body sleeve.

9. The assembly of claim 8: and said releasing means comprises a profile on said outer housing for shifting said collet into inner body and seal means releasing position when said profile is in longitudinal alignment with said collet.

10. A seal receptacle assembly for affixation intermediate a tubing string in a well to compensate for longitudinal contraction and expansion of the tubing string, comprising: an inner body sleeve having a lower end connected to an upper end of a lower section of the tubing string and defining an outwardly facing static sealing surface; an outer housing circumjacent said inner body sleeve and having an upper end connected to a lower end of an upper section of the tubing string, said housing defining an inwardly facing dynamic sealing surface; an annular seal means having an inner surface sealingly engaging said static sealing surface and an outer surface sealingly engaging said dynamic sealing surface; and securing means for releasably securing said seal means to said inner body sleeve whereby said outer housing moves longitudinally relative to said inner body sleeve and said seal means during normal longitudinal contraction and expansion of the tubing string, said outer housing including means for actuating said securing means to release said seal means from said inner body sleeve and permit said seal means to be lifted from said inner body sleeve by upward movement of said outer housing.

11. The assembly of claim 10 wherein said outer housing includes means for engaging said seal means when said seal means is released from said inner body sleeve whereby said seal means is retrieved from the well with said outer housing.

12. The assembly of claim 11 wherein said means for engaging includes an upwardly facing, inwardly extending annular shoulder formed on said outer housing below said dynamic sealing surface for engaging a lower end of said seal means.

13. The assembly of claim 10 wherein said inner body sleeve has an annular groove formed adjacent an upper end of said static sealing surface, and said securing means includes a radially compressible retaining ring compressed into said groove by an inner wall of said outer housing, said retaining ring preventing upward movement of said seal means with respect to said inner body sleeve.

14. The assembly of claim 10 wherein said inner body sleeve has an annular groove adjacent an upper end of said static sealing surface, and said securing means includes a radially inwardly compressible, outwardly urgeable collet means received in said groove and retained therein by the inner wall of said outer housing, whereby said collet means selectively prevents upward movement of said seal means with respect to said inner body sleeve.

15. The assembly of claim 10 wherein said inner body sleeve has an annular groove formed adjacent an upper end of said static sealing surface, and said seuring means includes a radially expandable element retained in said groove by the inner wall of said outer housing, whereby said expandable element selectively prevents upward movement of said seal means with respect to said inner body sleeve.

16. The assembly of claim 10 wherein said inner body sleeve has an upwardly facing, outwardly extending shoulder formed thereon below said static sealing surface for preventing downward movement of said seal means with respect to said inner body sleeve.

17. The assembly of claim 10 wherein said means for actuating includes an annular groove formed in an inner surface of said outer housing below said dynamic sealing surface whereby, upon upward movement of said outer housing and alignment of said outer housing annular groove with said secruing means, said securing means moves outwardly from said inner body sleeve annular groove into said outer housing annular groove to release said seal means from position on said inner body sleeve for transfer to said outer housing for retrieval to the top of the well.

18. A latch assembly for affixation between first and second members of a tubular conduit in a subterranean well, said assembly comprising: an inner body sleeve having one end connected to one of the members and defining an outwardly facing first sealing surface; an outer housing circumjacent said inner body sleeve and having one end connected to the other of the members, said outer housing defining an inwardly facing second sealing surface; an annular seal means having an inner surface sealingly engaging said first sealing surface and an outer surface sealingly engaging said second sealing surface; securing means for releasably securing said seal means to said inner body sleeve; and releasing means operable by extreme upward movement of said outer housing for releasing said securing means and permitting said seal means to be shifted onto and carried by said second sealing surface and to move upwardly with said outer housing, for retrieval from the well.

* * * * *